US005353750A

United States Patent [19]

Threatt

[11] Patent Number: 5,353,750

[45] Date of Patent: Oct. 11, 1994

[54] APPARATUS FOR SEALING A FOAM INSULATED WATER HEATER

[75] Inventor: Gary S. Threatt, Kershaw, S.C.

[73] Assignee: AOS Holding Company, Milwaukee, Wis.

[21] Appl. No.: 68,495

[22] Filed: May 27, 1993

[51] Int. Cl.[5] ..... F22B 37/36

[52] U.S. Cl. ..... 122/494; 122/14; 122/17; 126/361

[58] Field of Search ..... 122/494, 13.1, 16, 17, 122/19, 14; 126/361

[56] References Cited

U.S. PATENT DOCUMENTS 4,790,290 12/1988 Chevalier ..... 126/361

5,117,810 6/1992 Threatt ..... 126/361

*Primary Examiner*—Carroll B. Dority

*Attorney, Agent, or Firm*—David R. Price

[57] ABSTRACT

A water heater comprising a tank defining a water chamber and having an outer surface, a spud mounted on the outer surface, a jacket surrounding the tank and having an inner surface spaced from the tank outer surface, an opening aligned with the spud, a margin around the opening and converging inwardly toward the tank, insulating material between the tank and the jacket, and a fitting threaded into the spud and having a tapered outer surface which engages the margin to form a seal against the insulating material.

11 Claims, 1 Drawing Sheet

APPARATUS FOR SEALING A FOAM INSULATED WATER HEATER

BACKGROUND OF THE INVENTION

The invention relates to foam insulated water heaters, and more particularly to an apparatus for sealing foam insulated water heaters.

A conventional foam insulated water heater includes a water tank having therein at least one opening. An internally threaded spud is welded or otherwise secured to the outer surface of the tank in alignment with the tank opening. An outer jacket surrounds the tank and has therein an opening aligned with the spud. A fitting extends through the opening in the outer jacket and is threaded into the spud. The fitting is adapted to be connected to a pipe or other component communicating with the interior of the tank via the spud.

It is known in the art to inject foam into the space between the outer jacket and the tank in order to insulate the tank. During injection of the foam, it is desirable to prevent the foam from flowing out of the opening in the outer jacket. To this end, it is known to connect to the spud a sealing apparatus which provides a seal between the spud and the jacket. See, for example, U.S. Pat. No. 5,117,810.

SUMMARY OF THE INVENTION

It is desirable to provide an apparatus for sealing the opening in the jacket of a foam insulated water heater, which apparatus minimizes the number of parts required and does not require removal after the foaming process is completed.

Accordingly, the invention provides a water heater including a tank having therein an opening. The tank includes an outer surface. A spud is mounted on the outer surface in alignment with the opening in the tank. The water heater also includes a jacket surrounding the tank. The jacket is spaced from the tank outer surface and has therein an opening aligned with the spud. The jacket also includes a margin around the opening, which margin is indented or converges inwardly toward the tank. A fitting extends through the opening in the jacket and is threaded into the spud. The fitting includes a tapered outer surface which engages the margin of the jacket to form a seal between the margin and the fitting. Insulating material is injected between the tank and the jacket to insulate the tank and prevent the loss of heat from the water in the tank.

A principal feature of the invention is the provision of a sealing arrangement that does not require an additional sealing member. The seal is automatically provided by threading the fitting into the spud.

Other features and advantages of the invention will become apparent to those skilled in the art upon review of the following detailed description, claims and drawings.

Figure 1:
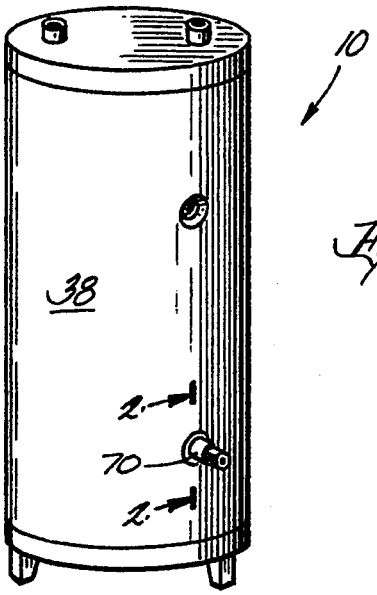
FIG. 1 is a perspective view of a water heater embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DESCRIPTION OF THE PREFERRED EMBODIMENT

Figure 2:
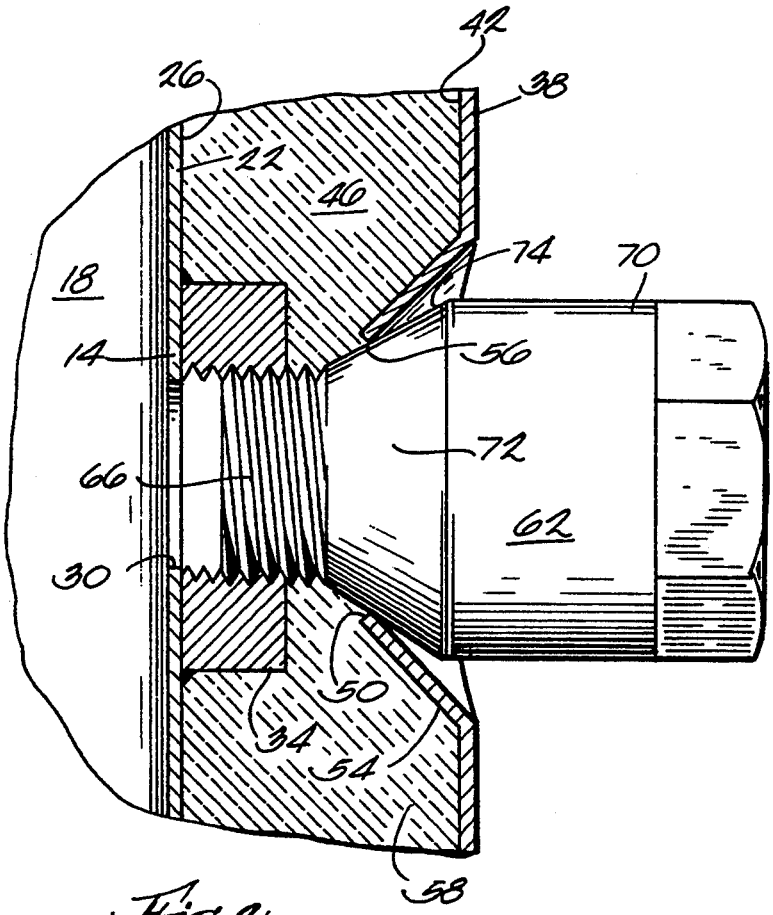
FIG. 2 is an enlarged partial cross-sectional view taken along line 2—2 in FIG. 1.

The drawings show a water heater 10 which includes a tank 14 defining a water chamber 18 (FIG. 2). The tank 14 has a generally cylindrical wall 22 including an outer surface 26 and having therein an opening 30 communicating with the water chamber 18. A threaded spud 34 is mounted on the outer surface 26 in alignment with the opening 30. As is known in the art, the spud 34 may be welded to tank 14 or mounted to tank 14 using other appropriate means.

The water heater 10 also includes a generally cylindrical jacket 38. The jacket 38 surrounds both the top and sides of the tank 14 and includes an inner surface 42 which is spaced from the tank outer surface 26 to form a space 46 between the tank 14 and the jacket 38. The jacket 38 includes an opening 50 which is aligned with the spud 34. The jacket 38 also includes a margin or indented portion 54 which surrounds the opening 50. The margin converges inwardly toward the tank 14 and terminates at an edge 56 defining the opening 50.

The water heater 10 also includes an insulating material 58 in the space 46 between the outer surface 26 of tank 14 and the inner surface 42 of jacket 38. In the preferred embodiment, the insulating material 58 is injected into the space 46 as a liquid foam during assembly of the water heater 10. The liquid foam cures a period of time after injection to form the substantially rigid insulating material 58.

The water heater 10 also includes a fitting 62 which is threaded into the spud 34. The fitting 62 provides a connection for a pipe to communicate with the water chamber 18 via the spud 34 and the tank opening 30. The fitting 62 includes a threaded reduced portion 66 which is inside the jacket 38 and which is threaded into the spud 34. The fitting 62 also includes an enlarged portion 70 outside the jacket 38. The fitting 62 also includes a connecting portion 72 between the portions 66 and 70. The connecting portion 72 narrows from the enlarged portion 70 to the reduced portion 66 and has an outer surface 74 which tapers inwardly from the enlarged portion 70 to the reduced portion 66 and which engages the edge 56 of the margin 54. The contact between the outer surface 74 and the edge 56 forms a seal against the insulating material and substantially prevents passage of the insulating material from the space 46 through the opening 50.

The water heater 10 is assembled as follows. First, the spud 34 is welded to the tank 14 in alignment with the tank opening 30. Then the jacket 38 is placed over the tank 14 so that the jacket opening 50 is aligned with the spud 34. The fitting 62 is threaded into the spud 34 so that the inwardly converging, tapered outer surface 74 of the fitting 62 engages the edge 56 of the jacket 38 to form a seal between the fitting 62 and the jacket 38. Engagement of the jacket by the fitting can cause the jacket margin to deflect inwardly, and the jacket's natural resistance to such deflection enhances the integrity of the seal. Finally, the foam insulating material 58 is injected into the space 46 between the tank 14 and the jacket 38. The seal substantially prevents the foam from flowing out of the opening 50 during the injection process.

In a series of alternative embodiments of the invention (not shown), the seal between the jacket and the fitting assumes a variety of forms. For example, in one embodiment, the jacket margin 54 is complementary with (i.e., has the same angle of taper as) the connecting portion 72. In another alternative embodiment, the edge 56 of the jacket margin is bevelled to create a surface which is complementary with the connecting portion 72. In both embodiments, the contact between the jacket 38 and the fitting 62 is increased.

In still another alternative embodiment (not shown), the jacket margin 54 is not indented. The jacket 38 simply has therein a circular opening 50 which includes an edge that may be bevelled. The fitting connecting portion 72 contacts the edge to provide a seal between the jacket 38 and the fitting 62.

In still another alternative embodiment (not shown), the fitting 62 does not include a tapered connecting portion 72. Rather, the fitting includes a stepped connecting portion defining an edge. The edge contacts the jacket 38, which may include a tapered margin 54, to provide a seal between the jacket 38 and the fitting 62.

Various features of the invention are set forth in the following claims.

I claim:

1. A water heater comprising a tank including a threaded opening, an outer jacket spaced from said tank, said jacket including an indented portion which is closer to the tank and which has therein an opening aligned with said tank opening, and a fitting threaded into said tank opening, said fitting having an enlarged portion outside said jacket, a reduced portion inside said jacket, and a connecting portion between said enlarged portion and said reduced portion, said connecting portion narrowing from said enlarged portion to said reduced portion and engaging said indented portion of said jacket so as to form a foam seal between said jacket and said fitting.

2. A water heater according to claim 1 wherein said tank threaded opening is defined by a spud, and wherein said fitting is threaded into said spud.

3. A water heater according to claim 2 wherein said indented portion includes an edge, and wherein said connecting portion engages said edge to form said seal.

4. A water heater comprising a tank having an outer surface and having therein an opening, a jacket surrounding said tank and having therein an opening aligned with said tank opening, insulating material between said tank and said jacket, and a fitting which is secured to said tank, which communicates with said tank opening, which extends through said jacket opening, and which has an outer surface engaging said jacket to form a seal between said fitting and said jacket, said jacket including an edge defining said opening and said fitting outer surface engages said edge, said fitting further including a reduced portion between said tank and said jacket and an enlarged portion outside said jacket, and wherein said outer surface converges inwardly from said enlarged portion to said reduced portion.

5. A water heater according to claim 4 wherein said jacket includes an inwardly converging margin around said edge.

6. A water heater according to claim 5 wherein said fitting is threaded into said tank opening.

7. A water heater according to claim 6 wherein said tank includes a spud, and wherein said fitting is threaded into said spud.

8. A water heater comprising a tank defining a water chamber and having an outer surface, a spud mounted on said outer surface, a jacket surrounding said tank, having an inner surface spaced from said tank outer surface, and having therein an opening aligned with said spud, said jacket defining around said opening a margin which converges inwardly toward said tank, insulating material between said tank and said jacket, and a fitting threaded into said spud and having a tapered outer surface which engages said margin to form a seal against said insulating material.

9. A water heater according to claim 8 wherein said fitting further comprises a reduced portion between said tank and said jacket and an enlarged portion outside said jacket, and wherein said outer surface converges inwardly from said enlarged portion to said reduced portion.

10. A water heater according to claim 9 wherein said margin includes an edge engaging said outer surface.

11. A water heater according to claim 10 wherein said tank has therein an opening, and wherein said spud is mounted on said tank in alignment with said opening.

* * * * *